US010786067B2

(12) United States Patent
VanHeusen

(10) Patent No.: US 10,786,067 B2
(45) Date of Patent: Sep. 29, 2020

(54) STRAP RETENTION ASSEMBLY

(71) Applicant: Joshua VanHeusen, Gastonia, NC (US)

(72) Inventor: Joshua VanHeusen, Gastonia, NC (US)

( * ) Notice: Subject to any disclaimer, the term of this patent is extended or adjusted under 35 U.S.C. 154(b) by 0 days.

(21) Appl. No.: 16/423,376

(22) Filed: May 28, 2019

(65) Prior Publication Data

US 2019/0365082 A1 Dec. 5, 2019

Related U.S. Application Data

(60) Provisional application No. 62/679,563, filed on Jun. 1, 2018.

(51) Int. Cl.
*A45F 3/02* (2006.01)
*A45F 3/00* (2006.01)

(52) U.S. Cl.
CPC ..... *A45F 3/02* (2013.01); *A45F 2003/001* (2013.01)

(58) Field of Classification Search
CPC ..... A45F 3/02; A45F 3/00; A45F 2003/001; Y10T 24/1391; Y10T 24/1394; Y10T 24/44026
See application file for complete search history.

(56) References Cited

U.S. PATENT DOCUMENTS 5,850,954 A * 12/1998 Dong-Joo ..... H04B 1/3888 224/197
6,163,894 A * 12/2000 Simonds ..... A47K 13/105 4/246.1
6,443,340 B1 * 9/2002 Chung ..... A45F 5/02 224/197
6,722,539 B2 * 4/2004 Iitsuka ..... A45F 5/02 224/197
6,752,299 B2 * 6/2004 Shetler ..... A45F 5/02 224/197
6,786,372 B2 * 9/2004 Enkerlin ..... A45F 5/02 224/196
7,303,276 B2 * 12/2007 Raymond ..... G02C 3/04 24/905
7,657,977 B2 * 2/2010 Clifton, Jr. ..... A45F 5/02 224/271
7,850,302 B1 * 12/2010 Riazi ..... A45F 5/02 24/3.3
8,579,172 B2 * 11/2013 Monaco ..... H04M 1/15 224/666

(Continued)

*Primary Examiner* — Robert Sandy
*Assistant Examiner* — Louis A Mercado
(74) *Attorney, Agent, or Firm* — Kim and Lahey Law Firm, LLC; Seann Lahey

(57) ABSTRACT

An elongated base plate for being secured to a mounting strap. An elongated rotating plate is pivotally carried by the base plate and configured to transition from extending along a plane parallel with the base plate to extending along a plane transverse to the base plate. A claw having a first end portion pivotally carried by the rotating plate. The claw is operable between an open position wherein a second end portion of the claw is spaced apart from the rotating plate, and a closed position wherein the second end portion engages the rotating plate. The base plate is thus mountable to the mounting strap so that the rotating plate is rotatable to position the claw to receive an accessory strap when the claw is in the open position and to secure the accessory strap between the claw and the rotating plate when the claw is in the closed position.

1 Claim, 7 Drawing Sheets

(56) References Cited

U.S. PATENT DOCUMENTS

| | | | | |
|---|---|---|---|---|
| 8,631,980 | B2 * | 1/2014 | Youssefi-Shams | A45F 5/021 224/197 |
| 8,783,531 | B2 * | 7/2014 | Kroupa | B65H 75/4431 224/162 |
| 8,919,622 | B1 * | 12/2014 | Gabriel | A45F 5/02 224/148.4 |
| 8,919,623 | B1 * | 12/2014 | Bergeron | A45F 5/02 224/148.4 |
| 9,611,881 | B2 * | 4/2017 | Khodapanah | F16B 21/06 |
| D801,585 | S | 10/2017 | Doody et al. | |
| 2002/0139822 | A1 * | 10/2002 | Infanti | A45F 5/00 224/197 |
| 2007/0094853 | A1 * | 5/2007 | Ferrari | A45F 5/02 24/580.1 |
| 2007/0289045 | A1 | 12/2007 | Evans et al. | |

* cited by examiner

STRAP RETENTION ASSEMBLY

BACKGROUND OF THE INVENTION

1) Field of the Invention

The present invention relates to a strap retention assembly used to position a strap, such as a backpack strap, in a desired position, especially when such backpack is worn over other gear.

2) Description of Related Art

When wearing a backpack, there are traditionally shoulder straps that are generally connected to the top and bottom of the pack designed to encircle the arms of the wearer and be positioned on the shoulders of the wearer. These straps place the load of the pack, and its contents, on the shoulders of the wearer to facilitate carrying the load. When the straps slip off the shoulders, the load can be undesirably placed on the upper arms or forearm.

One attempt to prevent the straps from slipping off the shoulders is to use a sternum strap positioned between the two straps and generally horizontally across the wearer's chest. However, when the wearer is carrying gear, such as with a military loadout, the sternum strap can interfere with accessing gear carried on the wearer. It would be advantageous to have a backpack with straps that maintain their position on the wearer's shoulders without the use of a sternum strap or other device that interferes with access of gear on the chest of the wearer.

For some wearer's a molle vest (or load bearing vest) is used to facilitate the carrying of loads on the wearer such as shown in United States Patent Application Publication 2007/0289045. The molle vest can includes spaced apart loop members that are used to attach a variety of items to the vest. It would be disadvantageous to have a strap interfere with access to these attached items on the front of the vest over the chest area. When wearing a backpack and a molle vest, the straps of the backpack can be more prone to slip out of place. One attempt to keep the backpack straps in place is shown in United States Design Patent D801585. However, the footprint of the device shown in this design patent occupies several loops of the molle system preventing these loops from being used for other items.

Accordingly, it is an object of the present invention to provide a strap retention assembly that can be attached to a molle vest and secure accessory straps such as a backpack strap in a desired position.

It is a further object of the present invention to provide a strap retention assembly that has a minimal footprint.

It is a further object of the present invention to provide a strap retention assembly that can be easily removed.

SUMMARY OF THE INVENTION

The above objectives are accomplished according to the present invention by providing a strap retention assembly comprising an elongated base plate for being secured to a mounting strap; an elongated rotating plate pivotally carried by said base plate configured to transition from extending along a plane parallel with said base plate to extending along a plane transverse to said base plate; a claw having a first end portion pivotally carried by said rotating plate; said claw having an open position wherein a second end portion of said claw is spaced apart from said rotating plate, and a closed position wherein said second end portion is engaging said rotating plate; whereby said base plate is mountable to the mounting strap so that said rotating plate is rotatable to position said claw to receive an accessory strap when said claw is in said open position and to secure said accessory strap between said claw and said rotating plate when said claw is in said closed position.

In a further advantageous embodiment, the strap retention assembly includes a hinge interconnecting said claw and said rotating plate; said hinge including a first hinge portion carried by said rotating plate, and a second hinge portion carried by said claw, and wherein said first and second hinge portions are pivotally connected to allow said claw to move between said open and closed positions.

In a further advantageous embodiment, said first hinge portion and said second hinge portion each include an opening receiving a hinge pin, wherein said hinge pin pivotally interconnects said first and second hinge portions.

In a further advantageous embodiment, the strap retention assembly includes a hinge stop operatively associated with said claw for limiting rotation of said claw beyond a predetermined angle.

In a further advantageous embodiment, said hinge stop includes a first engaging surface disposed on said rotating plate and a second engaging surface disposed on said claw, wherein contact between said first engaging surface and said second engaging surface resists pivotal movement of said claw.

In a further advantageous embodiment, said first engaging surface comprises a first flat surface adjacent said first hinge portion on said rotating plate.

In a further advantageous embodiment, said second engaging surface comprises a second flat surface disposed on said second hinge portion carried by said claw, wherein pivotal movement of said claw to a predetermined angle relative to said rotating plate directs said second flat surface to engage said first flat surface to resist further pivotal movement of said claw.

In a further advantageous embodiment, the pivotal movement of said claw between said closed position and said open position is less than or equal to about 40°.

In a further advantageous embodiment, said claw includes an arc portion defining a gap between said rotating plate and a bottom side of said claw for receiving said accessory strap when said claw is in said closed position.

In a further advantageous embodiment, said claw includes an end handle portion extending generally parallel to said rotating plate when said claw is in said open position.

In a further advantageous embodiment, said base plate has tapered opposing distal ends for facilitating insertion of said base plate into slots in the mounting strap; wherein said base plate includes a first portion for being received in a first mounting strap slot and a second portion for being receiving in a second mounting strap slot for mounting said base plate to the mounting strap.

In a further advantageous embodiment, the strap retention assembly includes a rotating plate stop operatively associated with said rotating plate for resisting rotation between said base plate and said rotating plate.

In a further advantageous embodiment, said base plate includes a first detent portion on a top surface engaging a second detent portion on a bottom side of said rotating plate, wherein said first detent portion engages said second detent portion to resist rotation when said rotating plate is aligned parallel with said base plate and when said rotating plate is aligned orthogonal to said base plate.

In a further advantageous embodiment, said rotating plate stop comprises a ridge dispose on at least one of the group consisting of said base plate and said rotating plate.

In a further advantageous embodiment, the strap retention assembly includes a first plate opening disposed centrally in said base plate, and a second plate opening disposed in a distal end portion of said rotating plate; wherein a securing member extends though said first and second plate openings pivotally interconnecting said base plate to said rotating plate.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention. Likewise, other objects, features, benefits and advantages of the present invention will be apparent from this summary and certain embodiments described below. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1C:
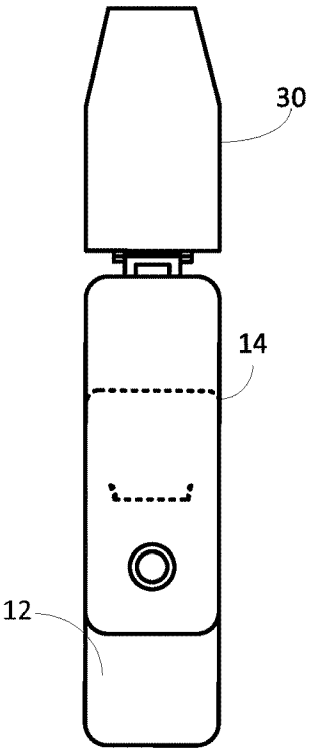
FIG. 1C is a top view of the strap retention assembly according to the present invention.
Figure 1B:
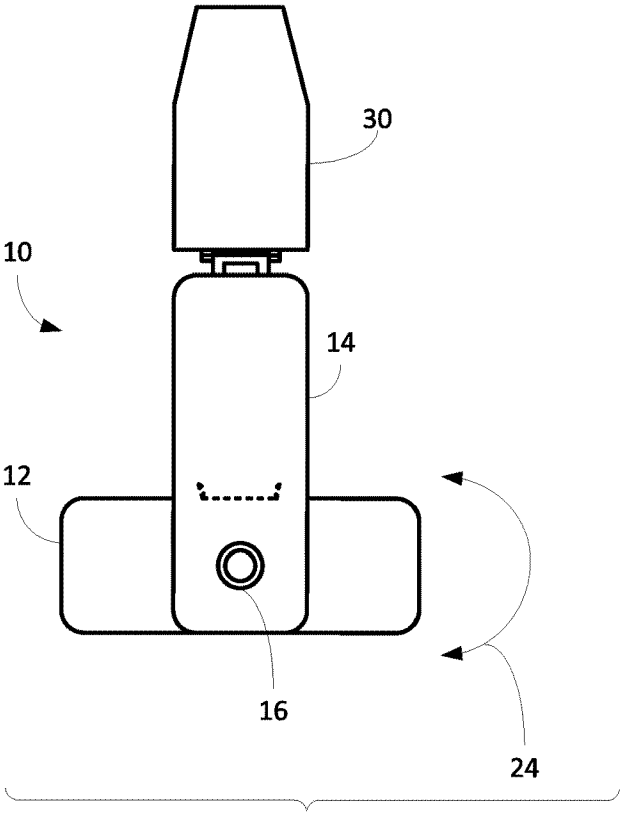
FIG. 1B is a top view of the strap retention assembly according to the present invention.
Figure 1A:
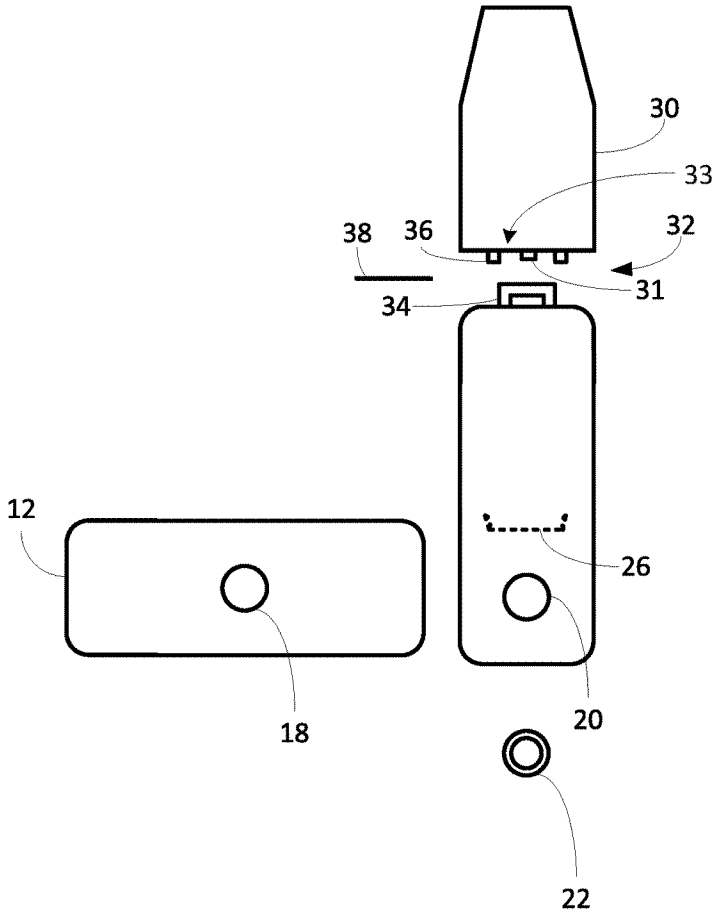
FIG. 1A is an exploded top view of the strap retention assembly according to the present invention.
Figure 4:
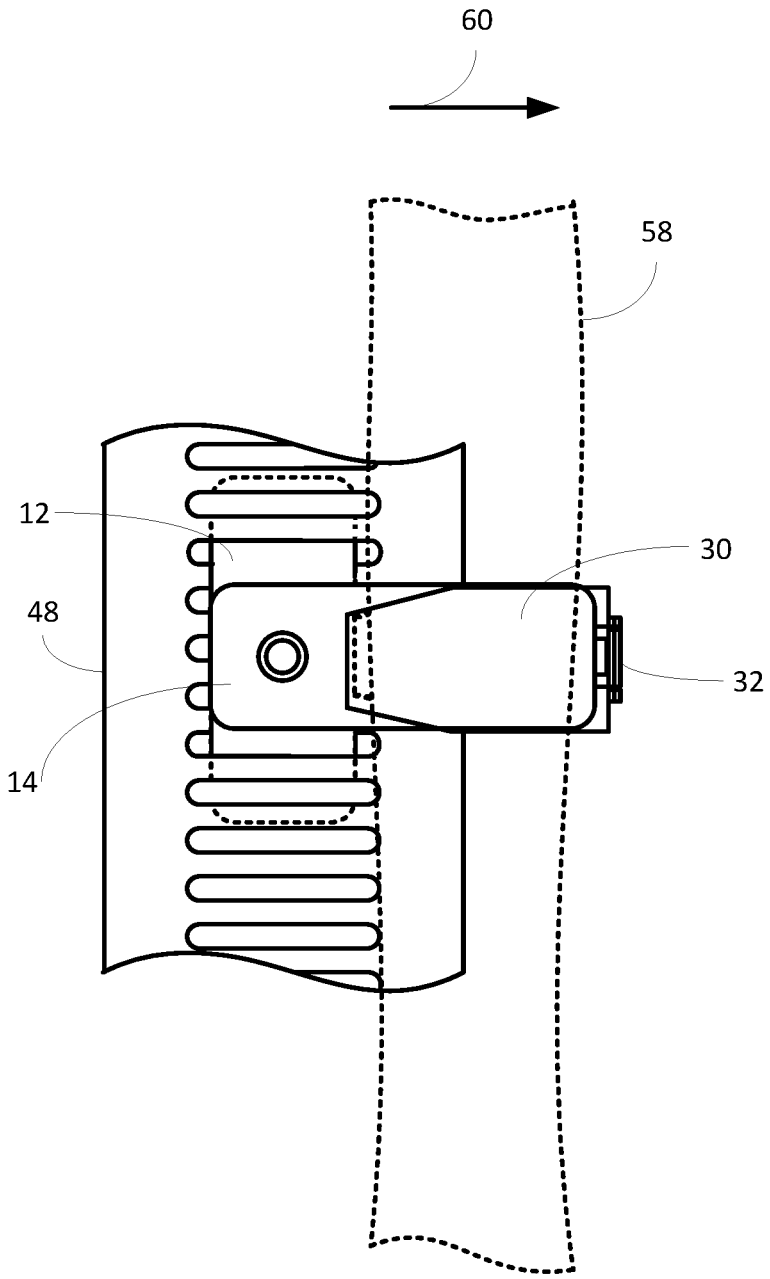
FIG. 4 is a top view of the strap retention assembly carried by the mounting strap and securing an accessory strap according to the present invention.

Referring to FIGS. 1A through 1C, a strap retention assembly 10 is shown having an elongated base plate 12 for being secured to a mounting strap 48 (FIG. 4). The base plate is attached to an elongated rotating plate 14 at pivot 16 configured to transition from extending along a plane parallel with base plate 12 to extending along a plane transverse to base plate 12. The pivot can be defined by a first plate opening 18, second plate opening 20, and pivot pin 22. In the illustrated embodiments, first plate opening 18 is disposed centrally in base plate 12, and second plate opening 20 is disposed in a distal end portion of rotating plate 14. A securing member comprised of pivot pin 22 extends though first and second plate openings 18 and 20, respectively, pivotally interconnecting base plate 12 to rotating plate 14. In the illustrated embodiment, the rotating plate 14 and the base plate 12 are positioned so that the first plate opening 18 and the second plate opening 20 are superimposed and the pivot pin 22 extends through the two openings so that the rotating plate 14 and the base plate 12 are attached to each other while also allowing the rotating plate to rotate along a path shown generally as 24.

Figure 6:
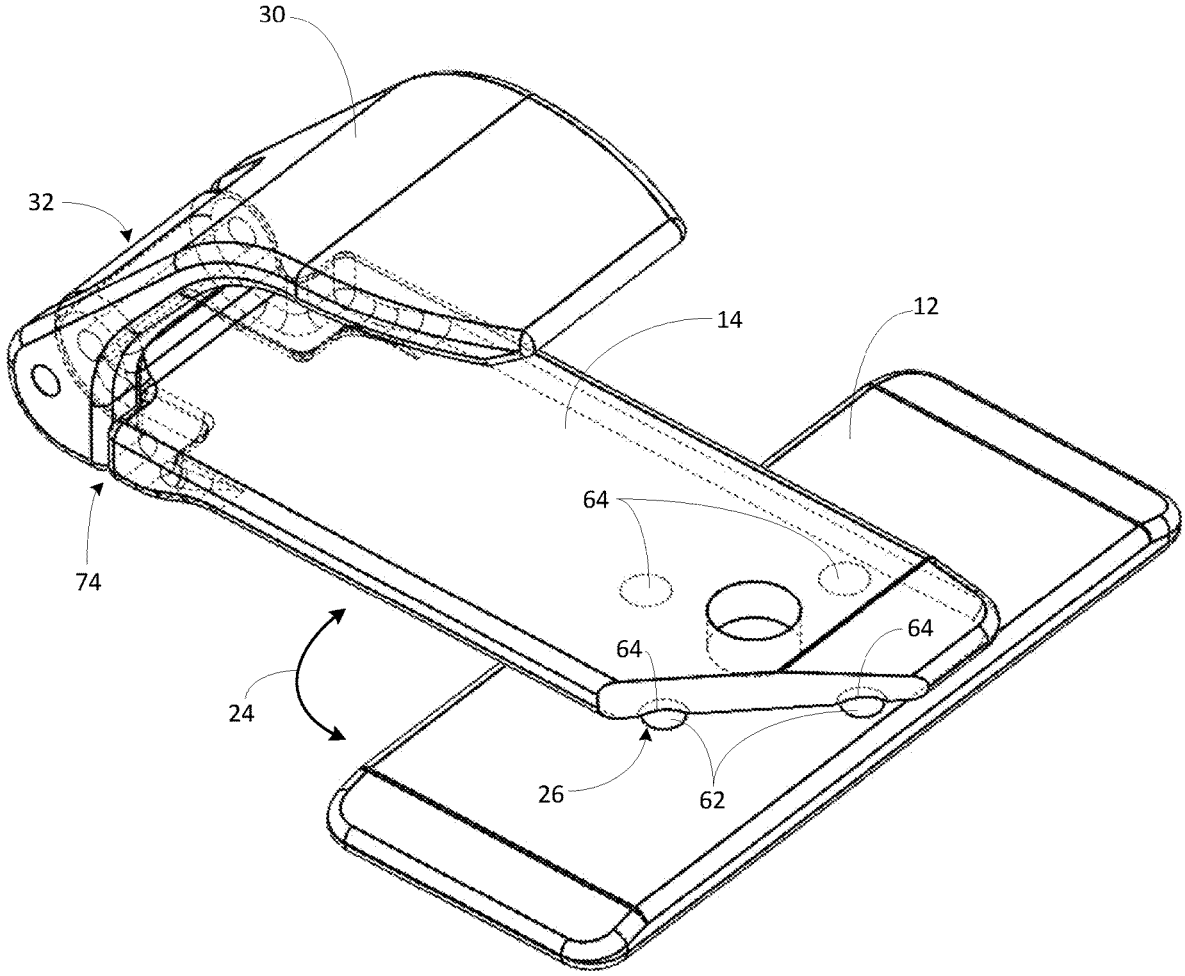
FIG. 6 is a perspective top view of a further embodiment of the strap retention assembly according to the present invention; and, FIG. 7 is an exploded top view of a further embodiment of the strap retention assembly according to the present invention.
Figure 7:
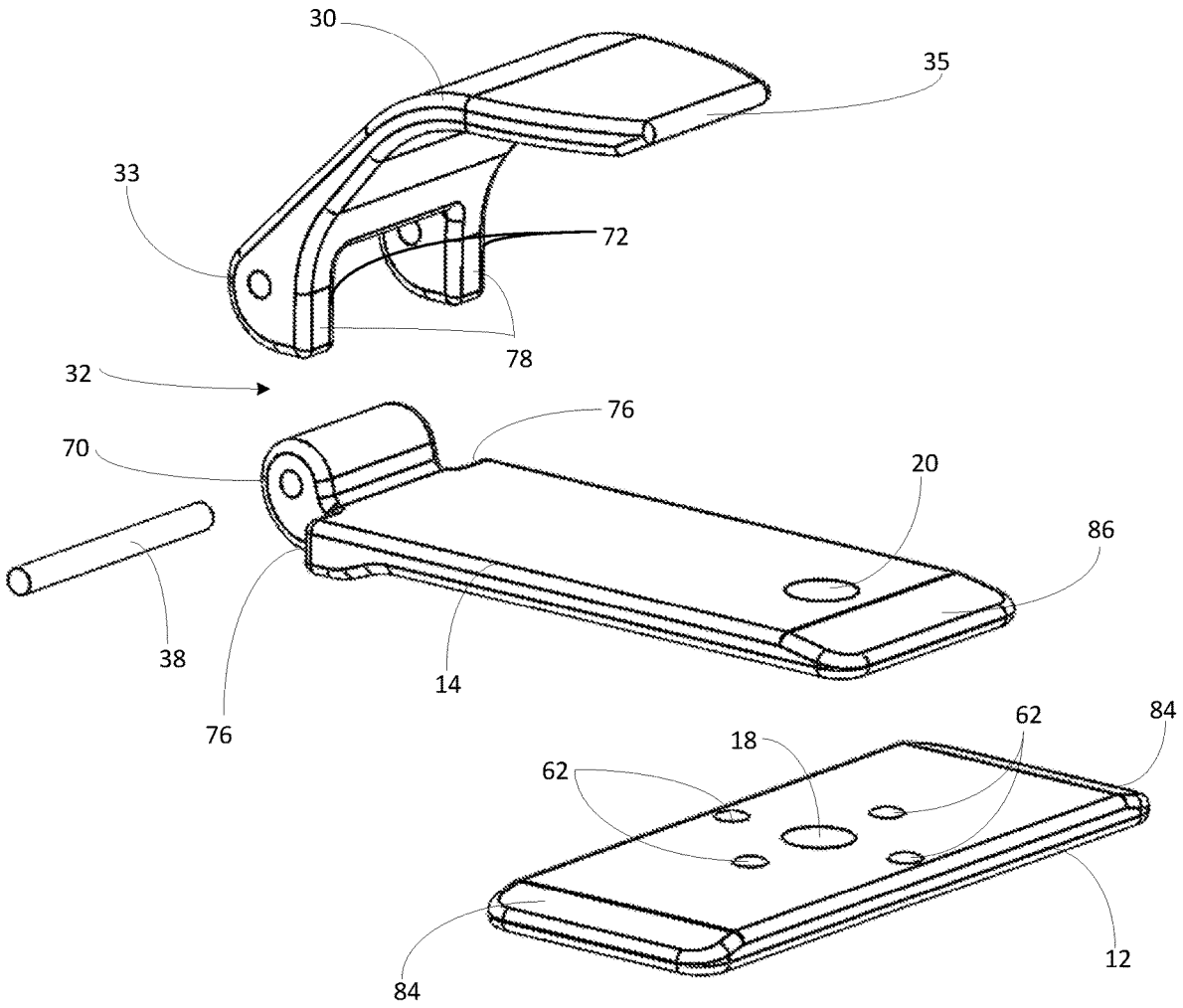

The strap retention assembly can be placed in an installed position shown in FIG. 1B or removable position as shown in FIG. 1C. When in the installed position, the rotating plate 14 is orthogonal in relation to base plate 12. A rotating plate stop 26 is operatively associated with rotating plate 14 for resisting rotation between base plate 12 and said rotating plate 14. In one example embodiment shown in FIGS. 1A-1C, the rotating plate stop 26 can be a raised portion or ridge included on one of the base plate or rotating plate to resist movement between the two plates. Referring to FIGS. 6 and 7, in a further advantageous embodiment, rotating plate stop, designated generally as 26, is shown wherein base plate 12 includes a first detent portion 62 on a top surface engaging a second detent portion 64 on a bottom side of rotating plate 14, wherein first detent portion 62 engages second detent portion 64 to resist rotation when rotating plate 14 is aligned parallel with base plate 12 and when rotating plate 14 is aligned orthogonal to base plate 12.

A claw 30 includes a first end portion 33 pivotally carried by the rotating plate 14 at hinge 32 interconnecting the claw and the rotating plate. Referring to the embodiment of FIGS. 5A and 5B, claw 30 has an open position wherein second end portion 35 of claw 30 is spaced apart from rotating plate 14, and a closed position wherein second end portion 35 engages rotating plate 14. With reference to FIG. 7, in the illustrated embodiment, the hinge, designated generally as 32, includes a first hinge portion 70 carried by the rotating plate, and a second hinge portion 72 carried by the claw, and wherein the first and second hinge portions 70, 72 are pivotally connected to allow the claw to move between the open and closed positions. The first hinge portion and the second hinge portion each include an opening receiving a hinge pin 38, wherein the hinge pin pivotally interconnects the first and second hinge portions.

Referring to FIGS. 5A through 7A, a hinge stop, designated generally as 74, is operatively associated with the claw for limiting rotation of the claw beyond a predetermined angle. In the illustrated embodiment, the hinge stop 74 includes a first engaging surface 76 disposed on the rotating plate and a second engaging surface 78 disposed on the claw, wherein contact between the first engaging surface and the second engaging surface resists pivotal movement of the claw. In the illustrated embodiment, the first engaging surface 76 comprises a first flat surface adjacent the first hinge portion 70 on the rotating plate 14. The second engaging surface 78 comprises a second flat surface disposed on the second hinge portion 72 carried by the claw, wherein pivotal movement of the claw to a predetermined angle relative to the rotating plate directs the second flat surface to engage the first flat surface to resist further pivotal movement of the claw. In a preferred embodiment, the pivotal movement of the claw between the closed position and the open position is less than or equal to about 40°.

Figure 5A:
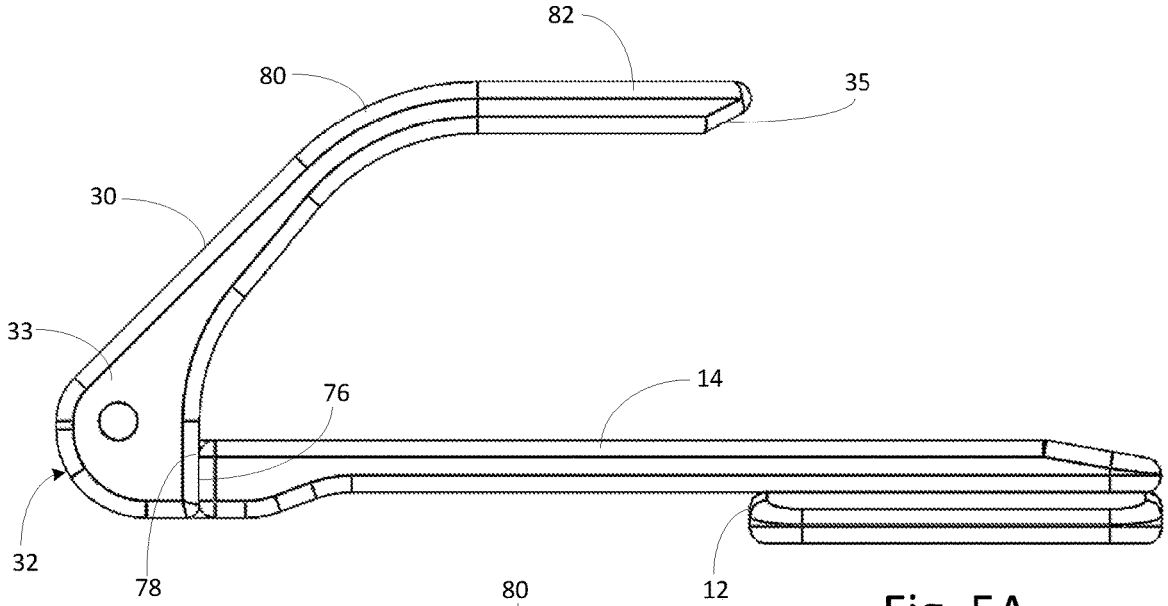
FIG. 5A is a side view of a further embodiment of the strap retention assembly in an open position according to the present invention.
Figure 5B:
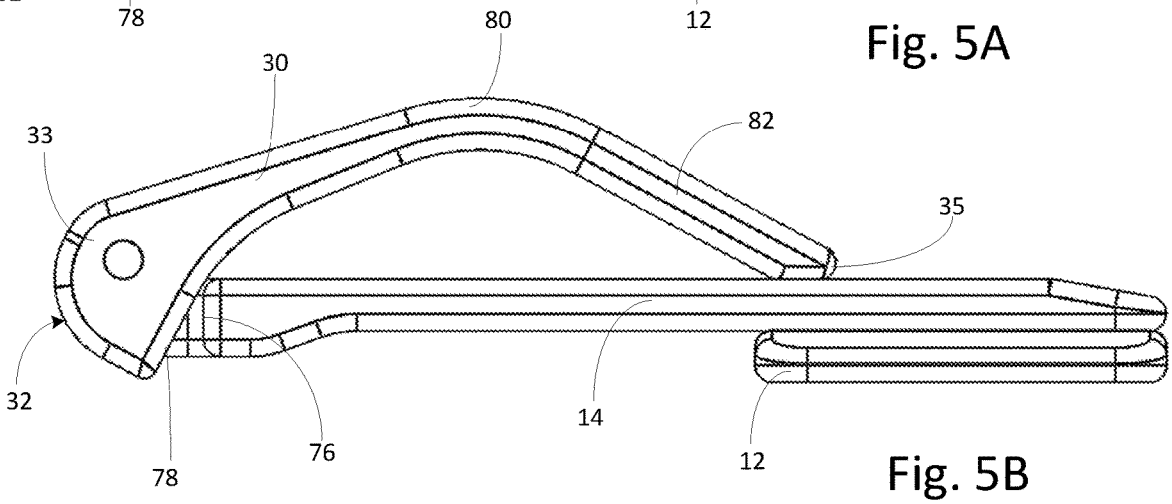
FIG. 5B is a side view of a further embodiment of the strap retention assembly in a closed position according to the present invention.

Referring to FIGS. 5A and 5B, the claw 30 includes an arc portion 80 defining a gap between the rotating plate and a bottom side of the claw for receiving the accessory strap 58 (FIG. 4) when the claw is in the closed position. Further, in the illustrated embodiment, the claw 30 includes an end handle portion 82 extending generally parallel to the rotating plate when the claw is in a fully extended open position (FIG. 5A).

Figure 2A:
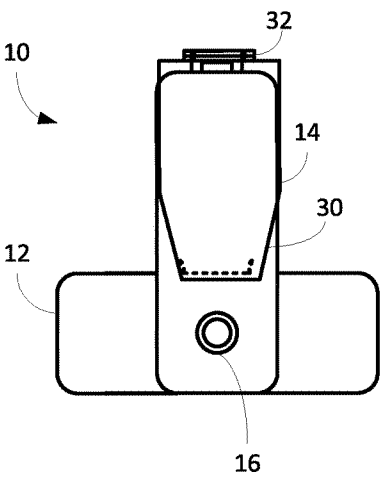
FIG. 2A is a top view of the strap retention assembly according to the present invention.
Figure 2B:
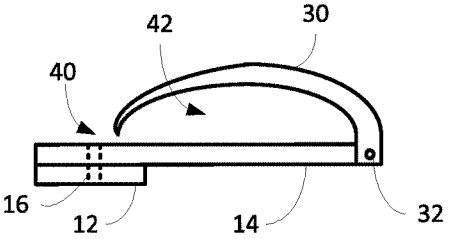
FIG. 2B is a side view of the strap retention assembly according to the present invention.
Figure 2C:
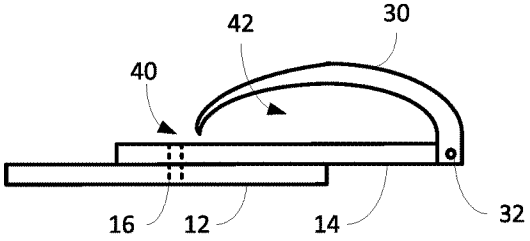
FIG. 2C is a side view of the strap retention assembly according to the present invention.

In the embodiment shown in FIGS. 1A-1C, the hinge 32 can include a rotating plate tab 34 carried by rotating plate 14, claw fork 36 carried by the first end portion 33 of claw 30 and pin 38 to define the hinge 32. The claw 30 can be in an open position as shown in FIGS. 1A through 1C. Referring to FIGS. 2A and 2C, the claw is shown in a closed position in the illustrated embodiment. In the closed position, the claw can contact the rotating plate or can define a gap 40 between the claw and the rotating plate if desired. A strap can be received in strap area 42. The strap retention assembly is shown in the installed position in FIG. 2B and in the removable position as shown in FIG. 2C. In the installed position, the base plate is positioned generally at a right angle to the rotating plate.

Figure 2D:
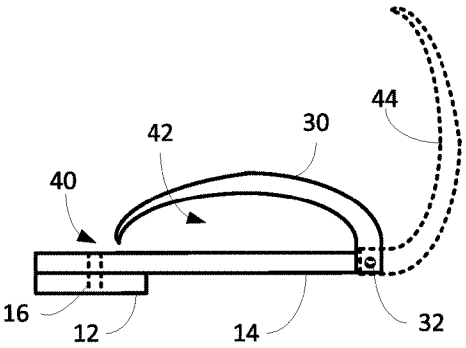
FIG. 2D is a side view of the strap retention assembly according to the present invention.
Figure 2E:
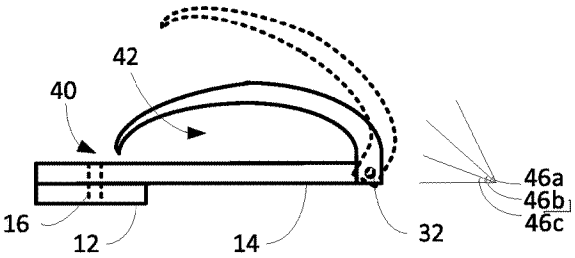
FIG. 2E is a side view of the strap retention assembly according to the present invention.

Referring to FIG. 2D, the hinge can include a hinge stop 31 that can position the claw in the open position without the claw traveling 180° or more relative to the rotating plate. The strap can then contact the inside edge 44 of the claw to position the strap in place. The claw can then be moved to the closed position securing the strap in the strap area. Referring to FIG. 2E, the hinge stop can prevent the claw from traveling past about a 40° angle 46*a* in one configuration, 30° angle 46*b* in one configuration, and 20° angle 46*c* in one configuration.

Figure 3B:
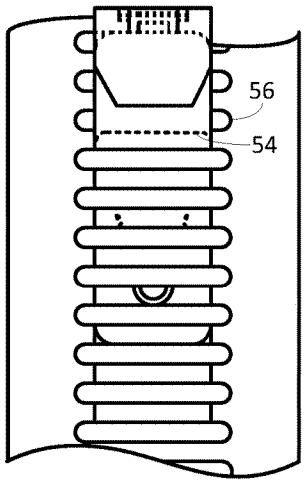
FIG. 3B is a top view of the strap retention assembly partially inserted into slots in the mounting strap according to the present invention.
Figure 3C:
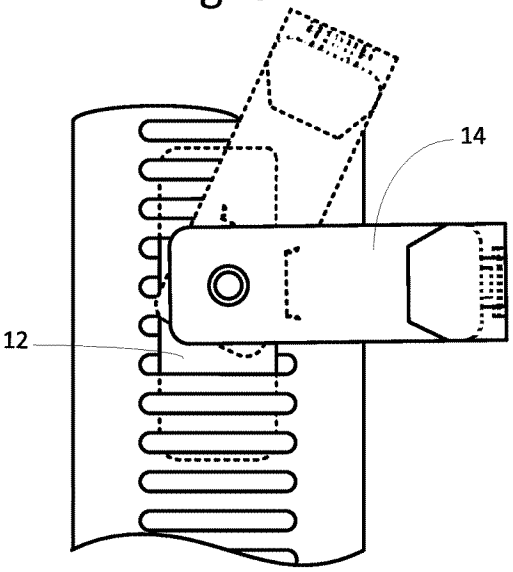
FIG. 3C is a top view of the strap retention assembly base plate fully secured into slots in the mounting strap according to the present invention.
Figure 3D:
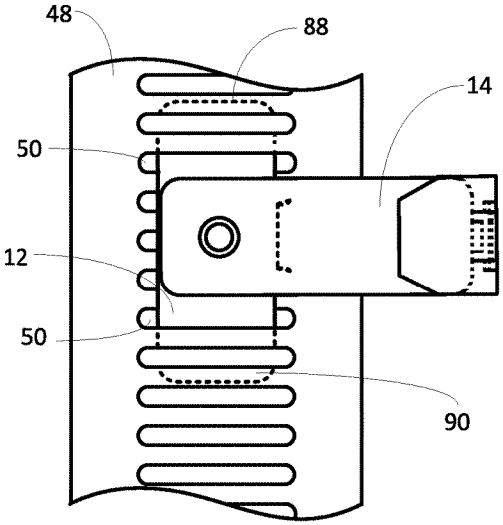
FIG. 3D is a top view of the strap retention assembly base plate fully secured into slots in the mounting strap and the rotating plate extending orthogonally to the base plate according to the present invention.
Figure 3A:
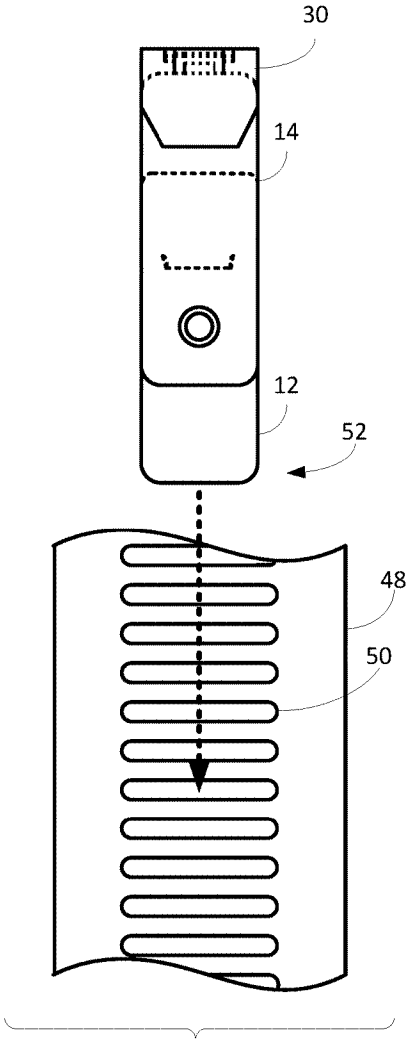
FIG. 3A is a top view of the strap retention assembly arranged for insertion into slots in a mounting strap according to the present invention.

Referring to FIG. 3A, the strap retention assembly is shown separated from a mounting strap 48 having a plurality of mounting openings 50. The base plate placed generally parallel to the rotating plate has a distal end 52 inserted into one of the mounting openings. Referring to FIG. 3B, the strap retention assembly is inserted through one of the mounting openings so that the base plate is disposed under the mounting strap and the rotating plate is partially positioned under the mounting strap. The strap rotating assembly is then pulled upwards allowing a base plate proximal end 54 to be inserted into another mounting opening such as mounting opening 56 so that the distal and proximal ends of the base plate are disposed under the mounting strap. Referring to FIG. 3C, the rotating plate can be pivoted so that the base plate is generally at a right angle to the rotating plate as shown in FIG. 3D.

In the illustrated embodiment of FIGS. 5A through 7, base plate 12 has tapered opposing distal ends 84 for facilitating insertion of base plate 12 into slots in the mounting strap. Rotating plate 14 also preferably includes a tapered distal end portion 86 to facilitate the initial insertion into the slots of the mounting strap as shown in FIGS. 3A and 3B. Referring to FIG. 3D, the base plate 12 includes a first portion 88 for being received in a first mounting strap slot and a second portion 90 for being receiving in a second mounting strap slot for mounting said base plate to the mounting strap 48.

Referring to FIG. 4, the accessory strap 58 is shown received in the claw 30 and prevented from moving in a direction 60 securing the strap to the wearer. Thus, base plate is mountable to the mounting strap 48 (FIG. 4) so that rotating plate 14 is rotatable to position claw 30 to receive accessory strap 58 when claw 30 is in an open position and to secure accessory strap 58 between claw 30 and rotating plate 14 when claw 30 is in a closed position.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A strap retention assembly comprising:

a mounting strap having a series of slots;

an elongated base plate carried in said slots of said mounting strap;

an elongated rotating plate rotatably carried by the base plate configured to transition from extending along a plane parallel with the base plate to extending along a plane transverse to the base plate;

a claw having a first end portion pivotally carried by said rotating plate; said claw having an open position wherein a second end portion of said claw is spaced apart from said rotating plate, and a closed position wherein said second end portion is engaging said rotating plate;

whereby said base plate is carried by said mounting strap so that said rotating plate is rotatable to position said claw to receive an accessory strap when said claw is in said open position and to secure said accessory strap between said claw and said rotating plate when said claw is in said closed position.

* * * * *